United States Patent [19]

Andis

[11] 4,443,688

[45] Apr. 17, 1984

[54] ELECTRICALLY HEATED HAIR CURLING APPLIANCE WITH REMOVABLE ROTATABLE HAIR GROOMING MEMBER

[75] Inventor: Matthew L. Andis, Racine, Wis.

[73] Assignee: Andis Company, Racine, Wis.

[21] Appl. No.: 278,192

[22] Filed: Jun. 29, 1981

Related U.S. Application Data

[63] Continuation-in-part of Ser. No. 059,676, Jul. 23, 1979, abandoned, which is a continuation-in-part of Ser. No. 120,511, Feb. 11, 1980, Pat. No. 4,358,660, which is a continuation-in-part of Ser. No. 222,590, Jan. 5, 1981, Pat. No. 4,368,376.

[51] Int. Cl.[3] ..... A45D 2/36; A46D 7/10; H05B 1/00

[52] U.S. Cl. ..... 219/222; 15/27; 132/11 R; 132/33 R; 132/34 R; 132/37 R; 132/85; 132/118; 219/225; 219/244; 219/533

[58] Field of Search ..... 219/222-226, 219/230, 533, 244; 132/9, 11 R, 85, 112, 117, 118, 33 R, 33 F, 33 G, 37 R, 37 A; 15/27

[56] References Cited

U.S. PATENT DOCUMENTS

| | | | |
|---|---|---|---|
| 1,518,442 | 12/1924 | Ostermann | 132/37 R |
| 1,546,046 | 7/1925 | Thompson | 132/37 R |
| 4,024,375 | 5/1977 | Olesen et al. | 219/225 |
| 4,029,110 | 6/1977 | Hyland | 219/222 X |
| 4,314,137 | 2/1982 | Dorm | 219/222 |
| 4,329,567 | 5/1982 | Kunz et al. | 132/11 R X |
| 4,365,426 | 12/1982 | Suzuki et al. | 219/222 X |

FOREIGN PATENT DOCUMENTS

| | | |
|---|---|---|
| 1170875 | 11/1969 | United Kingdom . |
| 2022406 | 12/1979 | United Kingdom . |
| 1558737 | 1/1980 | United Kingdom . |

*Primary Examiner*—A. Bartis

*Attorney, Agent, or Firm*—Michael, Best & Friedrich

[57] ABSTRACT

An electrically heated hair curling appliance includes a handle assembly having an electric heating element extending fixedly from one end thereof and a removable tubular hair grooming member mounted on the heating element for rotary and axial movement relative thereto. The hair grooming member may include, on its outer surface, a plurality rows of teeth defining a brush or a pivoted hair clamping member. A manually operable movable member is provided on the handle and is selectively sequentially movable between (1) a locked position wherein the movable member engages a first portion of the tubular member so as to prevent axial and rotary movement of thereof relative to the heating element, (2) a roll position wherein the movable member engages a second portion of the tubular member so as to prevent axial movement between the tubular member and heating element while permitting rotary movement therebetween and (3) a slide position wherein the movable member is free from engagement with the tubular member so as to permit both axial and rotary movement between the tubular member and heating element to facilitate assembly and disassembly of the tubular member from the heating element.

17 Claims, 10 Drawing Figures

10
13
91
21
15
29
171
183
185
185
41
115
113
115
123
123
113
111
131
3
3
93

13
93
33
27
27
15
21
29
25
95
75
53
73
95
71
51
25
65
55
77
67
79
31
57
31
43
43
45
81
143
145
43
147
45
141
153
41
115
125
141
123
121
101
111
113
105
122
109
17
131
8
8
7
7
ELECTRIC
HEATING
ELEMENT

Fig. 3
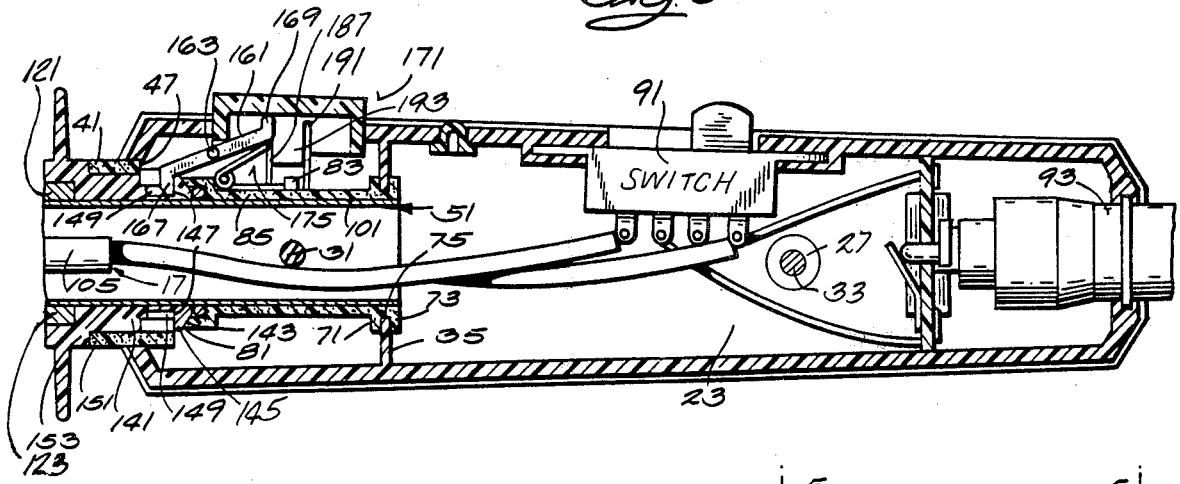
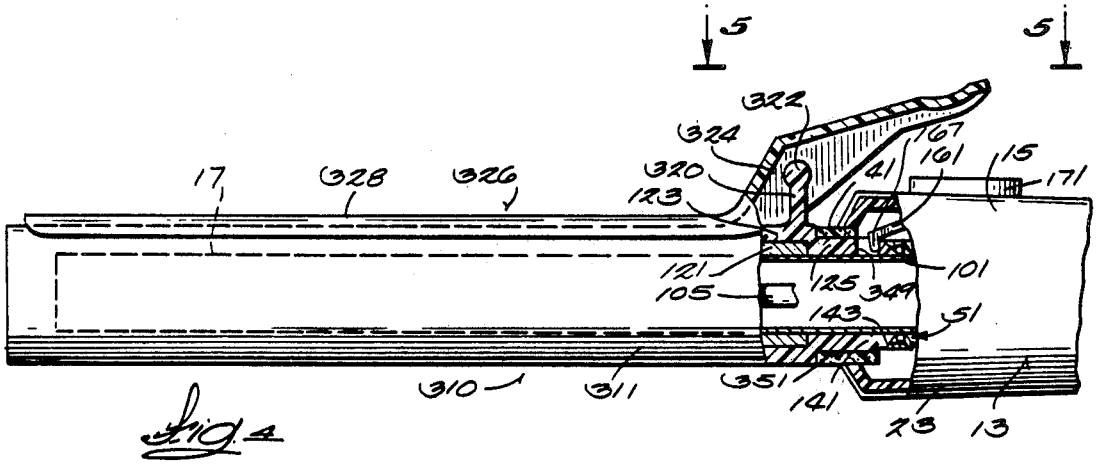
Fig. 4
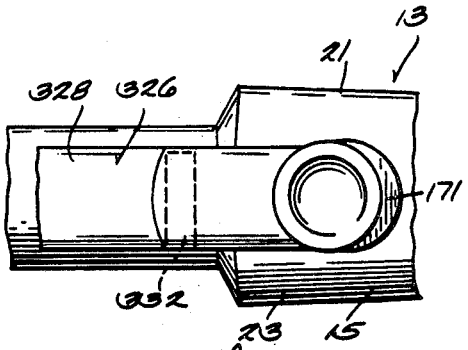
Fig. 5
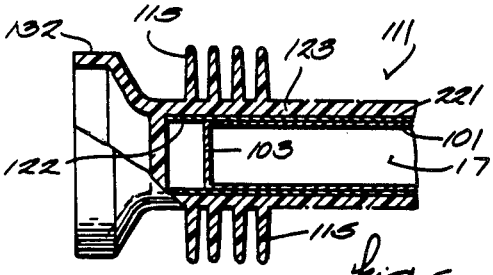
Fig. 6

ELECTRICALLY HEATED HAIR CURLING APPLIANCE WITH REMOVABLE ROTATABLE HAIR GROOMING MEMBER

RELATED APPLICATION

This application is a continuation in part of my earlier application Ser. No. 059,676 filed July 23, 1979 now abandoned, and of my earlier application Ser. No. 120,511 filed Feb. 11, 1980 and now U.S. Pat. No. 4,358,660, issued Nov. 9, 1982, and of my earlier application Ser. No. 222,590 filed Jan. 5, 1981 and now U.S. Pat. No. 4,368,376, issued Jan. 11, 1983.

BACKGROUND OF THE INVENTION

The invention relates generally to hair grooming devices or appliances and more particularly to curling brushes and/or irons.

Attention is directed to the British Pat. No. 1,170,875, published Nov. 19, 1969 and the British Pat. No. 1,558,737, published Jan. 9, 1980. In addition, attention is directed to British patent application No. 2,022,406, published Dec. 19, 1979. All of these documents relate to hair curling appliances which do not afford the desirable operating characteristics of the construction disclosed hereinafter.

SUMMARY OF THE INVENTION

The invention provides a hair curling appliance comprising a handle assembly including a handle and a heating element extending fixedly from the handle, a tubular member located on the heating element for rotary movement and axial movement relative thereto, and means on the handle assembly and on the tubular member and operable selectively for preventing axial and rotary movement of the tubular member relative to the handle assembly, for preventing axial movement of the tubular member relative to the handle assembly, while permitting rotary movement of the tubular member relative to the handle assembly, and for permitting axial and rotary movement of the tubular member relative to the handle assembly to facilitate assembly and disassembly of the tubular member and the handle assembly, which selectively operable means includes surfaces located on the handle assembly and on the tubular member and extending radially and axially in abutting engagement to prevent relative rotary movement between the handle assembly and the tubular member.

In one embodiment in accordance with the invention, the selectively operable means comprises a lever mounted on the handle assembly and sequentially pivotally movable between a locked position wherein the lever engages the tubular member so as to prevent axial and rotary movement between the tubular member and the handle assembly, a roll position wherein the lever engages the tubular member so as to prevent axial movement between the tubular member and the handle assembly while permitting rotary movement therebetween, and a slide position wherein the lever is free of engagement with the tubular member so as to permit both axial and rotary movement between the tubular member and the handle assembly.

In accordance with one embodiment of the invention, the hair curling appliance further includes means for actuating the lever for movement between the positions and including means biasing the lever toward the locked position from the slide position, and a control member movably carried on the handle assembly and including means engageable with the lever for pivotally displacing the lever against the action of the biasing means from the locked position to the slide position in response to movement of the control member relative to the handle assembly.

In one embodiment in accordance with the invention, the selectively operable means comprises an annular rib extending radially outwardly from the inner end of the tubular member, and at least one socket located in the tubular member adjacent to the rib and extending axially from the rib in the direction away from the inner end, and the lever is located in the socket when the lever is in the locked position, and the lever engages the annular rib when the lever is in the roll position.

In one embodiment in accordance with the invention, the lever is movably mounted on the handle and the movable member comprises a button movable into and out of the handle and engaged with the lever.

In one embodiment in accordance with the invention, the tubular member includes a plurality of rows of teeth.

In one embodiment in accordance with the invention, the tubular member includes thereon a pivotally mounted clamping member.

In one embodiment in accordance with the invention, the handle assembly includes therein a sleeve and the heating element comprises a metallic tube extending from the sleeve, and the tubular member comprises an inner metallic tube located in telescopic relation to the heating element tube.

Other features and advantages of the embodiments of the invention will become known by reference to the following general description, claims and appended drawings.

IN THE DRAWINGS

FIG. 3 is a fragmentary, partially sectioned view taken along line 3—3 of FIG. 1.

FIG. 4 is a fragmentary elevational view, partially broken away and in section, of another embodiment of a hair curling appliance, embodying various of the features of the invention.

FIG. 5 is a fragmentary plan view taken generally in the direction of line 5—5 of FIG. 4.

FIG. 6 is a fragmentary view, partially broken away and in section, of another embodiment of a hair curling appliance embodying various of the features of the invention.

Figure 1:
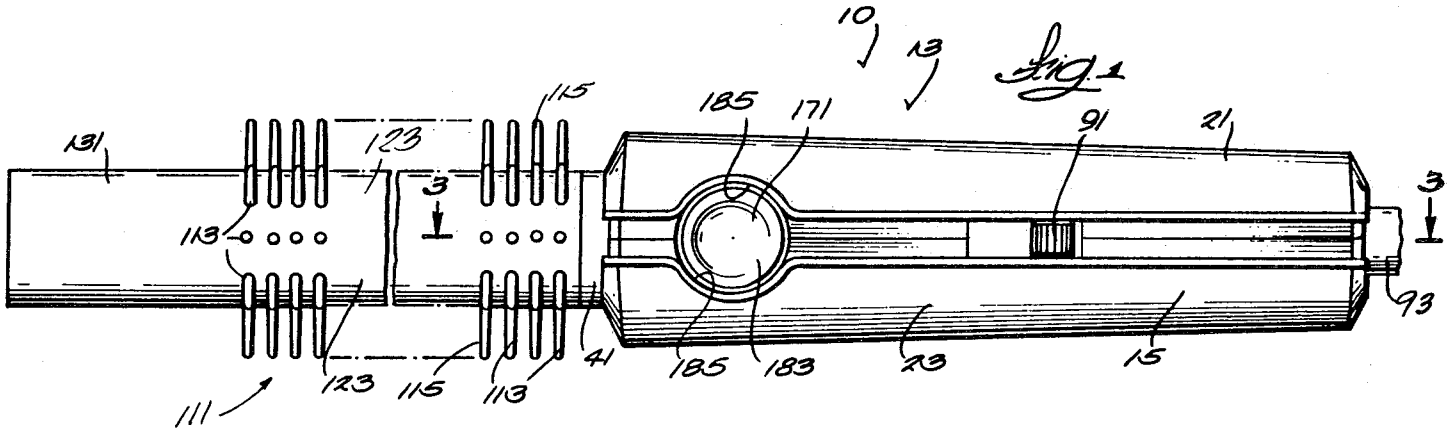
FIG. 1 is a plan view of a hair curling appliance incorporating various of the features of the invention.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Figure 2:
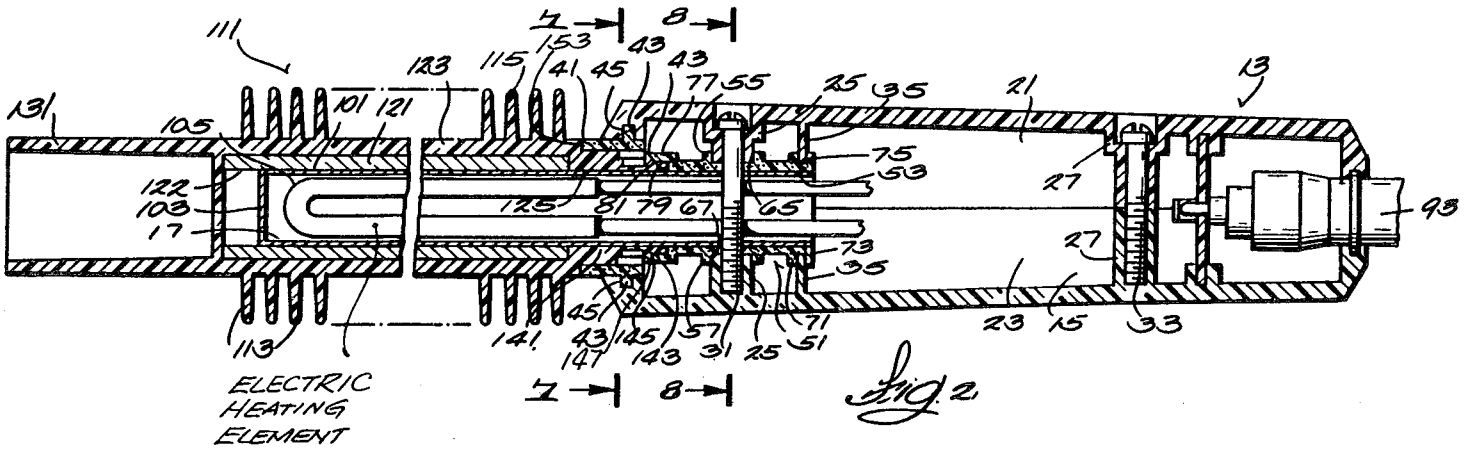
FIG. 2 is a sectioned view of the hair curling appliance show in FIG. 1.

Shown in FIGS. 1, 2, and 3 is one embodiment of a hair curling appliance 10 which takes the form of a hair brush or curler and which includes a handle assembly 13 comprising a handle 15 and a fixedly extending heating element 17. The handle 15 can be constructed in various ways and, in the illustrated construction, comprises a pair of identically constructed half handle sections 21 and 23 which are preferably fabricated of plastic, such as polycarbonate. Each of the handle half sections 21 and 23 includes (See FIG. 2) a pair of bosses 25 and 27 for receiving a pair of screws 31 and 33 which hold the handle half sections 21 and 23 in assembled relation. In addition, each of the handle half-sections 21 and 23 includes an internal, inwardly extending web 35.

Carried by the handle 15, at the left end thereof, as shown in FIGS. 1, and 2, is an end cap 41 which is preferably molded of an electrically insulating metallic alloy and which is generally cylindrical except for a pair of oppositely extending pins or studs 43 which are received in mating openings or recesses 45 in the otherwise circular end of the handle 15, and except for a notch or cutout 47 (See FIG. 3) along the inner edge or margin of the end cap 41 to afford clearance for movement of a lever 169 still to be disclosed.

Figure 9:
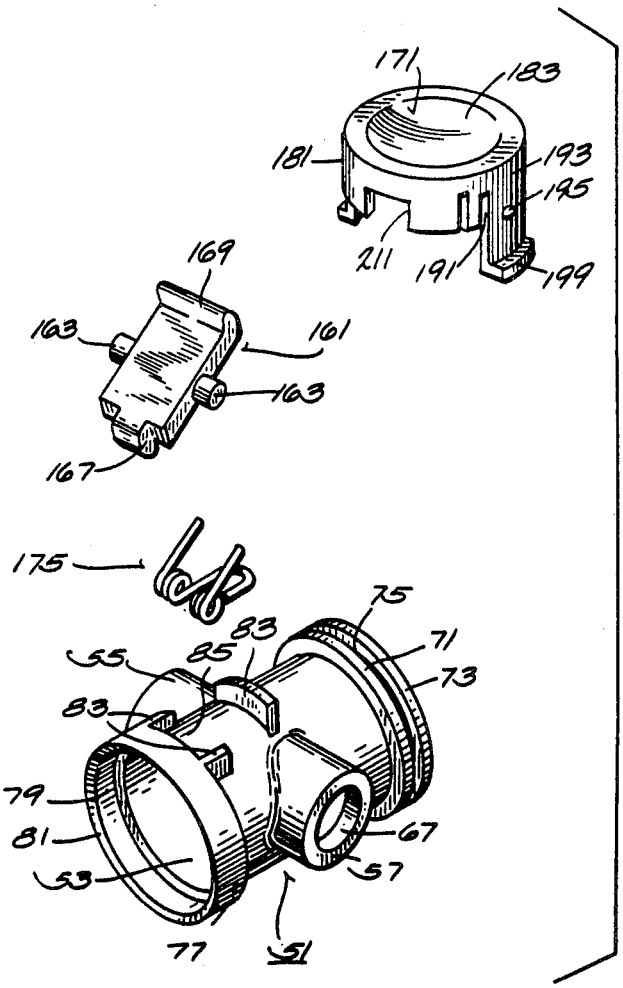
FIG. 9 is a composite perspective view of various of the components incorporated in the hair curling appliances shown in FIGS. 1 and 4.
Figure 10:
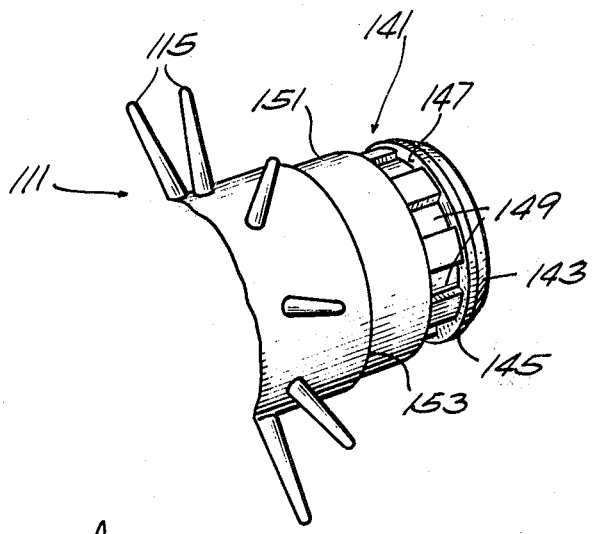
FIG. 10 is a partial perspective view of the nose end of the tubular brush assembly.

The handle 15 also includes an insulating sleeve 51 which is shown best in FIG. 9, which is also preferably molded from an electrically insulating metallic alloy and which is generally of cylindrical construction including an internal bore 53, except as will be hereinafter described. In this regard, the sleeve 51 includes two oppositely projecting bosses 55 and 57 which respectively includes recess 65 and 67 receiving the end portions of the bosses 25 of the handle half sections 21 and 23. Extending through the bosses 55 and 57 is a diametric bore which accepts the screw 31 to fixedly locate the sleeve 51.

In addition, at the right end thereof, the sleeve 51 includes a pair of adjacently spaced radially outwardly extending annular ribs 71 and 73 which define therebetween an annular groove 75 receiving the webs 35 extending from the handle half sections 21 and 23 to assist in properly locating the sleeve 51 relative to the handle 15.

The sleeve 51 also includes, adjacent the left end thereof, an enlarged portion 77 defining a counterbore 79 having an entering chamfered surface 81.

Still further, in addition, the outer surface of the sleeve 51 is provided with three ribs 83 which form a pocket 85 for receiving a spring still to be described.

Also mounted on the handle 15 is an electric switch 91 which controls energization of the heating element 17 and which is connected to an electrical cord 93 exiting from the right end of the handle 15.

The heating element 17 comprises (See especially FIG. 2) an outer cylindrical tube 101 which, at its outer end, is closed by a transverse end wall 103, which is fabricated of heat transmitting metal, and which, at its inner end, passes through the end cap 41 in spaced relation thereto and is snuggly telescopically and fixedly received in the sleeve 51. The cylindrical tube 101 is held against disassembly by the screw 31 which passes diametrically through the inner end of the cylindrical tube 101.

Suitably fixed within the outer cylindrical tube 101 is an electrical resistor 105 which is connected to the switch 91 and which, in response to energization thereof, heats the heating element 17.

Removably receivable on the cylindrical heating element 17 for axial and rotatable movement relative thereto is a tubular member or assembly 111 which includes a series of rows 113 of teeth 115, whereby to constitute the tubular member or assembly a tubular brush assembly.

More particularly, while various other arrangements could be employed, in the illustrated construction, the removable tubular brush assembly 111 comprises (See especially FIG. 2) an inner metallic tube 121 including a bore 122 which snugly telescopically fits on the outer tube 101 of the heating element to provide good heat transmissibility. Molded onto the inner tube 121 is a plastic sleeve 123 having inner and outer ends and plurality of the angularly spaced longitudinal rows 113 of teeth 115. The inner end of the sleeve 123 is fabricated with a bore 125 which constitutes an extension of the bore 122 of the inner tube 121, and which, when the tubular brush assembly 111 is received on the heating element 17, locates the inner tube 121 in closely encircling relation to the outer tube 101 of the heating element 17. At its outer end, the tubular brush assembly 111 includes an extension 131 projecting beyond the end wall 103 of the heating element 17, which extension 131 can be employed by the operator to grip the tubular brush assembly 111 in order to manipulate the tubular brush assembly 111 relative to the handle assembly 13. The extension 131 can be generally cylindrical in form or can be in the form of an outwardly extending bell 132 as shown in FIG. 6. Also shown in FIG. 6 is a tube 221 of lesser thickness than the tube 121 of FIG. 1.

Mean are provided on the inner end of the tubular brush assembly 111 and on the handle assembly 13 for selective engagement therebetween so as, selectively, to lock the tubular brush assembly 111 against rotary and axial movement relative to the heating element 17, to retain the tubular brush assembly 111 against axial movement, while permitting relative rotary movement between the tubular brush assembly 111 and the heating element 17, and to permit relative axial and rotary movement between the tubular brush assembly 111 and the heating element 17. Relative rotary movement between the tubular brush assembly 111 and the handle assembly 13 is prevented by respective surfaces which extend thereon radially and axially and which abuttingly engage to prevent relative rotation.

In this regard, while various constructions can be employed, in the illustrated construction, the inner end of the tubular brush assembly 111 is fabricated with a nose 141 having a chamfered entry surface 143 terminating in an annular rib 145 defining a radially extending annular flange or shoulder 147. The chamfered entry surface 143 cooperates, during insertion of the tubular brush assembly 111 into the sleeve 51, with the internal chamfered surface 81 on the sleeve 51, to guide such insertion and to abut the chamfered surfaces 81 and 143 so as to locate the tubular brush assembly 111 co-axially with the heating element 17.

Extending axially from the flange 147 is one or more notches or sockets 149 whch are formed in a cylindrical surface of reduced diameter as compared to the annular rib 145 and which extend from the flange 147 in the direction away from the inner end. In the disclosed construction, nine such notches 149 are equiangularly located about the cylindrical surface of reduced diameter.

Axially outwardly of the notches 149, the nose 141 includes a cylindrical surface 151 having a diameter somewhat larger than that of the annular rib 143 and adapted to be closely telescopically received within the bore of the housing end cap 41. The cylindrical surface 151 terminates in an annular shoulder 153 adapted to engage the outer end surface or margin of the housing end cap 41 when the tubular brush assembly 111 is fully inserted on the heating element 17.

Figure 7:
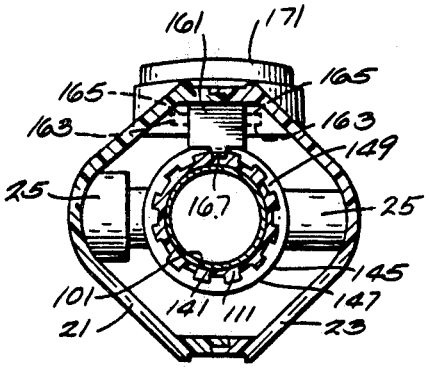
FIG. 7 is a sectional view taken generally along line 7—7 of FIG. 2.

The means for selectively connecting the tubular brush assembly 111 to the handle assembly 13 also includes a lever 161 (See FIGS. 3, 7 and 9) which, intermediate the ends thereof, includes oppositely extending pins or studs 163 which are received in mating blind holes 165 in the handle half sections 21 and 23 to thereby support the lever 161 for pivotal movement. The lever 161 also includes, at its outer ends, oppositely extending end projections 167 and 169. The end projection 167 selectively engages the nose 141 of the tubular brush assembly 111 and the end projection 169 engages the undersurface of a button 171 which is movably mounted in the handle 15.

More specifically, the button 171 comprises one component of means for displacing the lever 161 between a locked position wherein the lever end projection 167 is located in one of the sockets 149 so as to abutingly engage the axially and radially extending side surfaces of the lever end projection 167 and the socket 149 to prevent axial and rotary movement between the tubular brush assembly 111 and the handle assembly 13, a roll position wherein the lever end projection 167 engages the flange 147 so as to prevent axial outward movement of the tubular brush assembly from the heating element 17, while permitting rotary movement therebetween, and a slide position wherein the lever end projection 167 is free of engagement with the tubular brush assembly 111 so as to permit both axial and rotary movement between the tubular brush assembly 111 and the handle assembly 13.

The means for displacing the lever 161 also includes (See FIGS. 3 and 9) a spring 175 which is received in the pocket 85 formed in the outer surface of the sleeve 51 and which bears against the lever 161 to urge movement of the lever 161 in the counter-clockwise direction as shown in FIG. 3, i.e., from the slide position toward the locked position.

The button 171 is employed to displace the lever 161 in the opposite direction against the action of the spring 175, i.e., in the clockwise direction, from the locked position to the slide position. More particularly, the button 171 includes a cylindrical wall 181 and an end wall 183 which closes the outer end of the cylindrical wall 181 and which is somewhat concave to accommodate a user's finger. The button 171 is received (See FIG. 1) in an opening in the handle assembly 13 formed by mating semi-circular notches or cutouts 185 located in the handle half sections 21 and 23 along the mating plane between the handle half sections 21 and 23.

Means are provided on the button 171 and on the handle assembly 13 for guiding button movement and for preventing disassembly of the button 171 from the handle assembly 13 and for releaseable retention of the button 171 in the position locating the lever 161 in the roll position. More particularly, the margin around the semi-circular notch 185 in each of the handle half sections 21 and 23 forming the opening for the button 171 is provided with a pair of parallel ribs 187 which extend in the direction of button movement and into a pair of parallel elongated slots 191 extending axially from the open end of, and on diametrically opposite sides of, the button cylindrical wall 181. Each pair of slots 191 also serves to define therebetween a tab 193 and provide some resilience to each tab 193.

Figure 8:
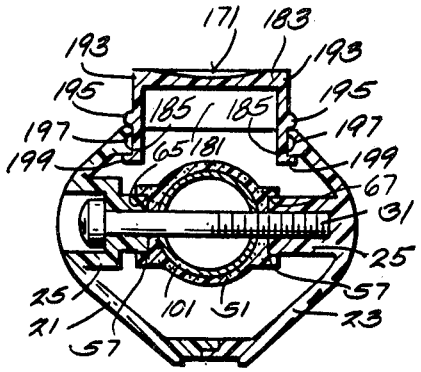
FIG. 8 is a sectional view taken generally along line 8—8 of FIG. 2.

In order to provide a detent action for locating the button 171 so as to locate the lever 161 in the roll position, each tab 193 is provided (See especially FIG. 8) with a semi-spherical projection 195 which is releasably receivable in a mating semi-spherical recess 197 in the adjacent handle half section 21 and 23.

The tabs 193 each also extend axially beyond the remainder of the inner edge of the button cylindrical wall 181 and include, at their innermost ends, radially outwardly extending projections 199 which engage the edge of the margins defining the semi-cylindrical notches 185 in the handle half sections 21 and 23 so as to limit axial outward movement of the button 171 and thereby prevent disassembly of the button 171 from the handle assembly 13, and establish the location of the button 171 which is effective to locate the lever 161 in the locked position.

The button 171 also includes a notch 211 which, like the notch 47 in the end cap 41, provides clearance for movement of the lever 161.

In operation, the tubular brush assembly 111 is telescopically slid over the heating element 17 until the chamfered nose surface 143 engages the inner chamfered surface 81 on the sleeve 51 in the handle assembly 13. Such insertion is permitted when the button 171 is fully depressed against the action of the spring 175 to rotate the lever 161 in the clockwise direction to the slide position with the end projection 167 clear of the tubular member or assembly 111. Release of pressure from the button 171 permits outward movement thereof under the influence of the spring 175 to either a position wherein the lever end projection 167 engages the annular flange 147 to prevent axial withdrawal of the tubular member or assembly 111 from the heating element 17, while at the same time affording relative rotation therebetween, or a position wherein the lever end projection 167 enters into one of the notches 149 to prevent both axial withdrawal and rotary movement of the tubular brush assembly 111 relative to the heating element 17. The spring 175 normally biases the button 171, and therefore the lever 161 to the locked position.

In the embodiment shown in FIG. 4, the curling appliance 310 comprises a hair curling iron and includes a tubular clamping assembly 311 which is constructed in much the same manner as already explained with respect to the tubular brush assembly 111, except that the chamfered entry surface 143 of the nose 141 terminates in a cylindrical surface 351 corresponding to the cylindrical surface 151 of the tubular brush assembly 111 and except that a single socket or notch 349 is provided in the cylindrical surface 351 for receipt of the end projection 167 of the lever 161, whereby both to prevent axial movement of the tubular clamping assembly 311 on the heating element 17 and to prevent rotary movement therebetween. In addition, the tubular clamping assembly 311 does not include teeth 115 but includes, adjacent the nose thereof, one or more posts 320 which extend from the sleeve 123 in a radial plane and which support a generally cylindrical rod 322 which extends transversely of the posts 320 and which is received into a notch 324 in the undersurface of a clamping member 326 so as to pivotally mount the clamping member 326 on the transverse rod 322. The clamping member 326 is formed with an extending clamping surface 328 which is arcuate in shape and which, when extending parallel to the sleeve 123, lies in closely adjacent relation thereto.

The tubular clamping assembly 311 can be assembled to the heating element 17 in replacement of the tubular brush assembly 111 by removal of the tubular brush assembly 111 and by sliding the tubular clamping assembly 311 onto the heating element 17 while the button 171 is fully depressed. Release of the button 171 to its outermost position by the spring 175 will locate the lever end projection 167 in the socket 349 to prevent axial and rotary movement of the tubular clamping assembly 311 relative to the heating element 17.

It is apparent that tubular brush assemblies 111 of varying sizes and tubular clamping assemblies 311 of varying sizes can be interchangeably mounted on a single heating element 17. Changes in the size of the tubular assemblies 111 and 311 can be readily obtained by changing the radial thickness of the inner tube 121 or by varying the radial thickness of the sleeve 123 in areas other than at the nose 141. In addition, of course, the height of the teeth 127 can vary from one tubular brush assembly 111 to another and even within the same tubular brush assembly 111. For instance, one row of teeth might be of a different height than another row of teeth. In addition, one row of teeth might be a different material than another row of teeth.

Various of the features of the invention are set forth in the following claims.

I claim:

1. A hair curling appliance comprising a handle assembly including a handle and a heating element extending fixedly from one end of said handle, a removable tubular member forming at least a part of a hair grooming means located on said heating element for rotary movement and axial movement relative thereto, and means on said handle assembly and on said tubular member and operable selectively for preventing axial and rotary movement of said tubular member relative to said handle assembly, for preventing axial movement of said tubular member relative to said handle assembly, while permitting rotary movement of said tubular member relative to said handle assembly, and for permitting axial and rotary movement of said tubular member relative to said handle assembly to facilitate assembly and disassembly of said tubular member and said handle assembly, said selectively operable means comprising a lever pivotally mounted on said handle assembly and sequentially pivotally movable between a locked position wherein said lever engages a first portion of said tubular member so as to prevent axial and rotary movement between said tubular member and said handle assembly, a roll position wherein said lever engages a second portion of said tubular member so as to prevent axial movement between said tubular member and said handle assembly while permitting rotary movement therebetween, and a slide position wherein said lever is free of engagement with said tubular member so as to permit both axial and rotary movement between said tubular member and said handle assembly, and means for actuating said lever for movement between said positions.

2. A hair curling appliance in accordance with claim 1 wherein said actuating means include means biasing said lever toward said locked position from said slide position, and a control member movably carried on said handle assembly and including means engageable with said lever for pivotally displacing said lever against the action of said biasing means from said locked position to said slide position in response to movement of said control member relative to said handle assembly.

3. A hair appliance in accordance with claim 1 wherein said lever is mounted on said handle and wherein said movable control member comprises a button movable into and out of said handle and engaged with said lever.

4. A hair curling appliance in accordance with claim 1 wherein said tubular member includes an inner end, wherein said selectively operable means comprises an annular rib extending radially outwardly from said inner end of said tubular member and defining said second portion, and at least one socket located in said tubular member adjacent to said rib and extending axially from said rib in the direction away from said inner end and defining said first portion, and wherein said lever is located in said socket when said lever is in the locked position, and wherein said lever engages said annular rib when said lever is the roll position.

5. A hair curling appliance in accordance with claim 4 wherein said tubular member includes a plurality of said sockets arranged in a circular array.

6. A hair curling appliance in accordance with claim 1 wherein said tubular member includes, on its outer surface, a plurality of rows of teeth.

7. A hair curling appliance in accordance with claim 1 wherein said tubular member includes thereon a pivotally mounted hair clamping member.

8. A hair curling appliance in accordance with claim 1 wherein said handle assembly includes therein a sleeve and wherein said heating element comprises a metallic tube extending from said sleeve, and wherein said tubular member includes an inner metallic tube located in telescopic relation to said heating element tube.

9. A hair curling appliance comprising a handle assembly including a handle and a heating element extending fixedly from one end of said handle, a removable tubular member forming a part of a hair grooming means and located on said heating element for rotary and axial movement relative thereto and including an inner end adjacent said handle, and means on said handle and on said inner end and operable selectively for preventing axial and rotary movement of said tubular member relative to said handle assembly, for preventing axial movement of said tubular member relative to said handle assembly, while permitting rotary movement of said tubular member relative to said handle assembly, and for permitting axial and rotary movement of said tubular member relative to said handle assembly to facilitate assembly and disassembly of said tubular member and said handle assembly, said selectively operable means comprising an annular rib extending radially outwardly from said inner end of said tubular member, at least one socket located in said tubular member adjacent to said rib and extending axially from said rib in the direction away from said inner end, a lever pivotally mounted on said handle and including oppositely extending first and second end projections, said lever being sequentially pivotally movable between a locked position wherein said lever first end projection is located in said socket so as to prevent axial and rotary movement between said tubular memory and said handle assembly, a roll position wherein said lever first end projection engages said annular rib so as to prevent axial movement between said tubular member and said handle assembly while permitting rotary movement therebetween, and a slide position wherein said lever first end projection is free of engagement with said tubular member so as to permit both axial and rotary movement between said tubular member and said handle assembly, and means for actuating said lever for movement between said positions and including means biasing said lever toward said locked position from said slide position, and a button movably carried on said handle and including means engageable with said lever second end projection for pivotally displacing said lever against the action of said biasing means from said locked position to said slide position in response to movement of said control member relative to said handle assembly.

10. A hair curling appliance in accordance with claim 9 wherein said tubular member includes, on its outer end, a plurality of rows of teeth.

11. A hair curling appliance in accordance with claim 9 wherein said tubular member includes thereon a pivotally mounted hair clamp member.

12. A hair curling appliance in accordance with claim 9 wherein said handle includes therein a sleeve, and wherein said heating element comprises a metallic tube extending from said sleeve, and wherein said tubular member comprises an inner metallic tube located in telescopic relation to said heating element tube.

13. A hair curling appliance comprising a handle assembly including a handle and a heating element extending fixedly from an end of said handle, a removable tubular member forming at least a part of a hair grooming means and located on said heating element for rotary movement and axial movement relative thereto, said tubular member including a first surface extending radially and axially of said tubular member and a second surface extending radially and transversely of the axis of said tubular member, and an element movably mounted on said handle assembly for selective engagement with said first and second surfaces so as, when said element is in engagement with both of said first and second surfaces, to prevent axial and rotary movement of said tubular member relative to said handle assembly, and so as, when said element is in engagement with said second surface and is free of engagement with said first surface, to prevent axial movement of said tubular member relative to said handle assembly, while permitting rotary movement of said tubular member relative to said handle assembly, and so as, when said element is free of engagement with both of said first and second surfaces, to permit axial and rotary movement of said tubular member relative to said handle assembly to facilitate assembly and disassembly of said tubular member and said handle assembly.

14. A hair curling appliance in accordance with claim 13 wherein said tubular member includes, on its outer surface, a plurality of rows of teeth.

15. A hair curling appliance in accordance with claim 13 wherein said tubular member includes thereon a pivotally mounted hair clamping member.

16. A hair curling appliance in accordance with claim 13 wherein said handle assembly includes therein a sleeve, and wherein said heating element comprises a metallic tube extending from said sleeve, and wherein said tubular member includes an inner metallic tube located in telescopic relation to said heating element tube.

17. A hair curling appliance comprising a handle assembly including a handle and a heating element extending fixedly from one end of said handle, a removable tubular member forming at least a part of a hair grooming means located on said heating element for rotary movement and axial movement relative thereto, and means on said handle assembly and on said tubular member and operable selectively for preventing axial and rotary movement of said tubular member relative to said handle assembly, for preventing axial movement of said tubular member relative to said handle assemby, while permitting rotary movement of said tubular member relative to said handle assembly, and for permitting axial and rotary movement of said tubular member relative to said handle assembly to facilitate assembly and disassembly of said tubular member and said handle assembly, said selectively operable means comprising a member movably mounted on said handle assembly and sequentially movable between a locked position wherein said movable member engages a first portion of said tubular member so as to prevent axial and rotary movement between said tubular member and said handle assembly, a roll position wherein said movable member engages a second portion of said tubular member so as to prevent axial movement between said tubular member and said handle assembly while permitting rotary movement therebetween, and a slide position wherein said movable member is free of engagement with said tubular member so as to permit both axial and rotary movement between said tubular member and said handle assembly, and means for actuating said movable member for movement between said positions.

* * * * *